US006804697B2

(12) United States Patent
Bugeja et al.

(10) Patent No.: US 6,804,697 B2
(45) **Date of Patent: *Oct. 12, 2004**

(54) CIRCUIT FOR PRECISE MEASUREMENT OF THE AVERAGE VALUE OF THE OUTPUTS OF MULTIPLE CIRCUIT UNIT ELEMENTS

(75) Inventors: Alexander Bugeja, Dallas, TX (US); Ching-yuh Tsay, Plano, TX (US); Irfan A. Chaudhry, Plano, TX (US); Mounir Fares, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 658 days.

This patent is subject to a terminal disclaimer.

(21) Appl. No.: 09/905,368

(22) Filed: Jul. 13, 2001

(65) Prior Publication Data

US 2002/0026469 A1 Feb. 28, 2002

Related U.S. Application Data

(60) Provisional application No. 60/220,371, filed on Jul. 24, 2000.

(51) Int. Cl.[7] ..... G06G 7/12
(52) U.S. Cl. ..... 708/805
(58) Field of Search ..... 708/202, 304, 708/445

(56) References Cited

U.S. PATENT DOCUMENTS 3,366,951 A * 1/1968 Lhermitte et al. ..... 342/26
3,371,200 A * 2/1968 Funk ..... 708/805
3,686,493 A * 8/1972 Schmid ..... 326/35
4,001,605 A * 1/1977 Thomas et al. ..... 327/355

* cited by examiner

*Primary Examiner*—Chuong Dinh Ngo
(74) *Attorney, Agent, or Firm*—Alan K. Stewart; W. James Brady, III; Frederick J. Telecky, Jr.

(57) ABSTRACT

An averaging circuit includes: input signal nodes for providing input signals 330; a multiplexing circuit 320 coupled to the input signal nodes for switching between the input signals 330 to create a time waveform; a low pass filter 300 coupled to an output 340 of the multiplexing circuit 320 for filtering the time waveform to create an average signal; and an average replication circuit 310 coupled to an output 350 of the low pass filter 300.

16 Claims, 2 Drawing Sheets

CIRCUIT FOR PRECISE MEASUREMENT OF THE AVERAGE VALUE OF THE OUTPUTS OF MULTIPLE CIRCUIT UNIT ELEMENTS

This application claims priority under 35 USC §119 (e) (1) of provisional application No. 60/220,371 filed Jul. 24, 2000.

FIELD OF THE INVENTION

This invention generally relates to electronic systems and in particular it relates to precise measurements of the average value of the outputs of multiple circuit unit elements.

BACKGROUND OF THE INVENTION

Dynamic Element Matching (DEM) is a technique frequently employed in applications where a number of unit elements exhibiting a certain degree of mismatch in their absolute values are to be matched to a certain resolution finer than the mismatch tolerance. Such situations occur, for example, in the capacitor arrays of multiplying digital-analog converter units (MDACs) of switched-capacitor analog-digital converts (ADCs), in the unit elements of multibit quantizer digital-analog converters (DACs) of sigma-delta feedback loops, etc. These situations are ideal for DEM implementations because they involve a large number of nominally identical unit elements. By randomly switching between these unit elements, all elements are effectively matched to the mean value of all the elements, reducing tones and harmonic distortion in the output spectrum. The tradeoff is an increase in noise level, since the energy present in the tones is not removed, and is randomized and spread over the entire noise floor. This tradeoff is often acceptable since the tones are the more serious factor limiting spectral performance.

DEM is not, however, straightforward to apply to all potential application areas where it might be of use. In particular, one example of such an area is that of segmented high speed and resolution DACs. In these applications, it is easy enough to apply DEM to the thermometer coded most significant bits (MSBs), but it is usually problematic to get the mean value of the MSBs to match the sum total of the least significant bits (LSBs), depending on the implementation. The matching between the MSBs and the sum of the LSBs is required for good static and dynamic linearity; matching inferior to the resolution required would show up statically as integral and differential non-linearity errors (INL and DNL respectively) and dynamically as tones in the spectral response once again. Unfortunately, in most circuit architectures and implementations, the LSBs cannot be integrated in the DEM scheme, owing to the existence of different time constants in the LSB circuit which would exist at the DEM multiplexing node where the LSB current divider circuit is being switched, and the effective sum total LSB value would be matched to the mean of the MSBs only for very low clock frequencies where this time constant would be negligible.

Shou et al. (U.S. Pat. No. 5,521,543) describe an averaging circuit composed of a number of parallel CMOS inverters with a common shorted output node. Such a circuit is capable of measurement of the average value, but the measurement is not precise owing to the inverter gain. Moreover, there is no provision for precise replication of the average value. Finally, the technique depends on the use of CMOS inverters and is not readily adapted to use in a current signal environment. Caruso (U.S. Pat. No. 5,298,814) describes a similar circuit with similar limitations.

Niiho et al. (U.S. Pat. No. 4,523,108) describes a circuit which uses a weighted summer as a form of averaging circuit. This allows for measurement of an average input value; there is, however, only provision of comparison to another signal, not replication of the averaged signal. This circuit is also not suitable for time-averaging applications such as DEM environments.

SUMMARY OF THE INVENTION

Generally, and in one form of the invention, the averaging circuit includes: input signal nodes for providing input signals; a multiplexing circuit coupled to the input signal nodes for switching between the input signals to create a time waveform; a low pass filter coupled to an output of the multiplexing circuit for filtering the time waveform to create an average signal; and an average replication circuit coupled to an output of the low pass filter.

DETAILED DESCRIPTION OF PREFERRED EMBODIMENTS

This invention is a practical circuit architecture for precise measurement of the average value of the outputs of a number of circuit unit elements, and provides precision replication of this value at some other point in the circuit where it may be required. Those skilled in the art will recognize that this invention can be used for the segmented DAC application referred to, as well as a number of other possible applications.

Figure 1:
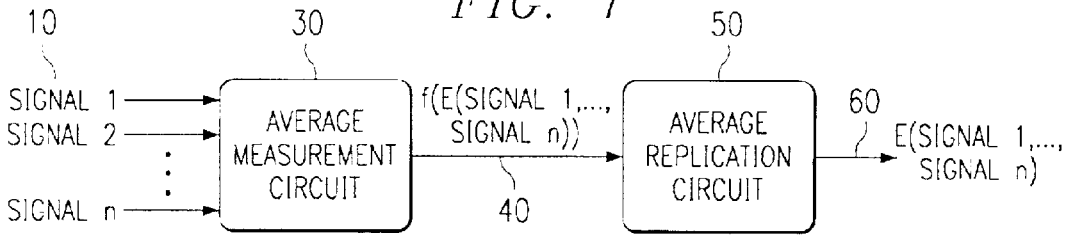
FIG. 1 is a block diagram of a preferred embodiment averaging circuit.

A block diagram of the preferred embodiment is shown in FIG. 1. It consists of an average measurement circuit 30 and an average replication circuit 50 driven by the average measurement circuit. The average measurement circuit 30 takes as inputs n input signals 10. In a DEM environment these signals 10 would be the DEM-matched signals under consideration, such as the MSB current sources of a segmented DAC with DEM applied to the MSBs. The average measurement circuit produces a function f of the average value E (average of the signals Signal 1, . . . , Signal n) as its output 40. The nature of this function depends on the implementation. It could be a unity function or some more complicated, typically nonlinear function. The output 40 of the average measurement circuit is the input of the average replication circuit 50, which produces from it the average value as the final output 60, in a form suitable for distribution to the point where it is required in the external circuit. In some applications it may be convenient for the signal 60 not to be the average value proper, but some function thereof as was the case with 40.

The preferred embodiment of FIG. 1 can be used in segmented DAC environments to match the sum of the LSBs to the average MSG value. To do this, the MSBs are applied in some time-multiplexed fashion, such as cyclically or randomly at a certain clock rate as the inputs 10 and the average replication circuit output 60 used in some way to set the value of the sum of the LSBs. If the MSBs are then matched to within the DAC resolution required, and the circuit of FIG. 1 implemented with this level of resolution also, then the overall DAC will meet the resolution requirement also, including the major carry points. Particular implementations of the preferred embodiment which meet these requirements are described below.

Figure 2:
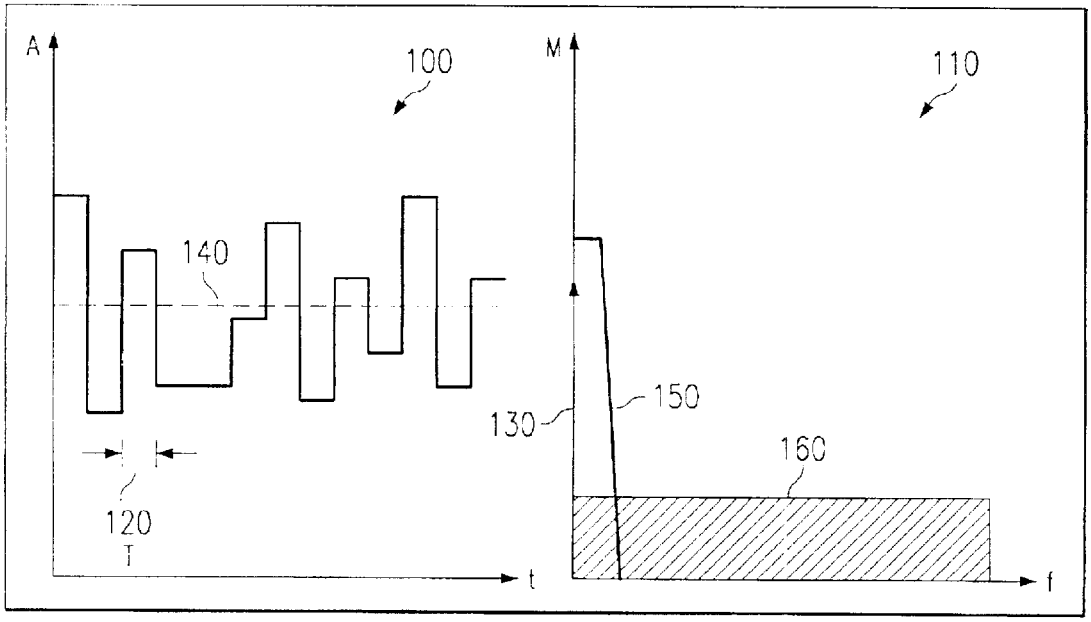
FIG. 2 is a time and frequency domain representation of the DEM waveforms observed when the input signals of the average measurement circuit are multiplexed.

A time and frequency domain representation of the DEM waveforms observed when the input signals of the average measurement circuit are multiplexed as shown in FIG. 2. In the time domain, the waveform 100 consists of the values of each of the n signals output for some period T 120, which is typically a constant clock period, in some pseudo-random or cyclical or otherwise deterministic fashion. If the order is ideally random, the element mismatch will be spread into white noise, with pseudo-random sequences approximating this condition. This situation is shown in the frequency domain representation 110, where the white noise floor 160 arises due to this mismatch. If the order is sequential, the mismatch will appear as distinct periodic tones, with a fundamental frequency and spacings equal to the repetition period of the entire sequence. In either case, the dc average value 140, which shows up in the frequency domain as the zero frequency component 130, is the desired arithmetic mean for the output 40 of the average measurement circuit 30. This component can be extracted by a low pass filter, with a characteristic similar to that represented by 150 in FIG. 2. The filter characteristic rejects most of the white noise down to dc in the random case, and attenuates the lowest harmonic tones at the repetition frequency arising from the mismatch in the sequential case. Therefore, for time averaging of the inputs in a DEM situation, some low pass filtering function should be inherent to the average measurement circuit.

Typically segmented DACs are current-mode for high-speed operation, with a number of thermometer-decoded MSB current sources, and a number of LSB current sources which are a combination of thermometer and binary-decoded. It is convenient for our purposes here to assume that the LSB current sources are driven by a single current source nominally equal to the MSB current sources within mismatch tolerances. Those skilled in the art will recognize that this does not constitute an intended limitation on the scope of this invention, however.

Figure 3:
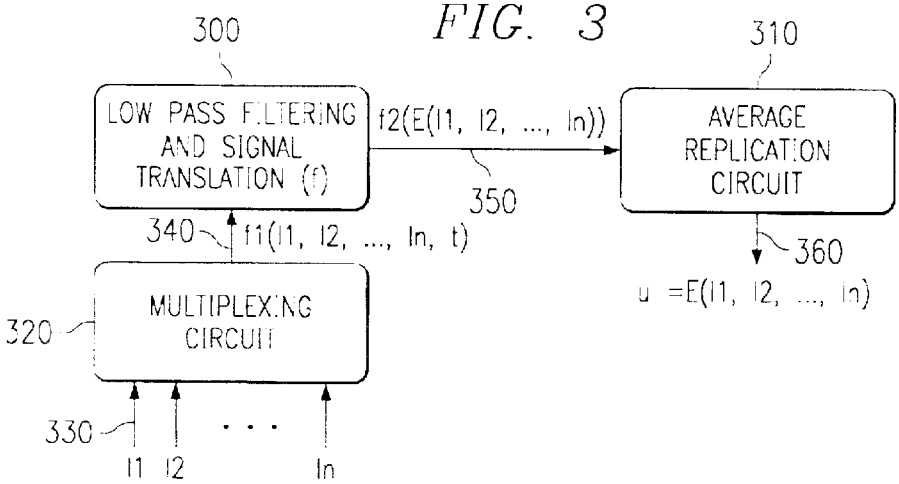
FIG. 3 is more detailed block diagram of the preferred embodiment of FIG. 1 as implemented in a current-mode DAC environment.

A more detailed description of the preferred embodiment of FIG. 1 as implemented in a current-mode DAC environment is shown in FIG. 3. In this implementation the average measurement circuit 30 of FIG. 1 has been broken into two parts: a low pass filtering and signal translation part 300, and a multiplexing circuit 320. The average replication circuit 310 is still on the right. The inputs to the multiplexing circuit 320 are currents 330 (I1, I2, . . . , In) which are typically the MSB currents. The role of the multiplexing circuit 320 is to switch among these currents 330, typically at a fast clock rate such as the DAC clock rate, to create the DEM time waveform similar to that shown in FIG. 2 as 100. The output 340 of this block is therefore in general a function f1 of all the current values a well as time, as shown in FIG. 3. This signal is low pass filtered by the block 300 to obtain the average value; this value may also be translated through some function f2 in general. The resulting signal is the output 360, analogous to output 40 in FIG. 1, and this is now fed to the average replication circuit 310. The output 360 of average replication circuit 310 is ideally the mean value of the DEM currents, and is represented by Iu in FIG. 3. FIG. 3 demonstrates the ideal case in which Iu=E(I1, I2, . . . , In), but in general there is some error committed in the averaging process.

Figure 4:
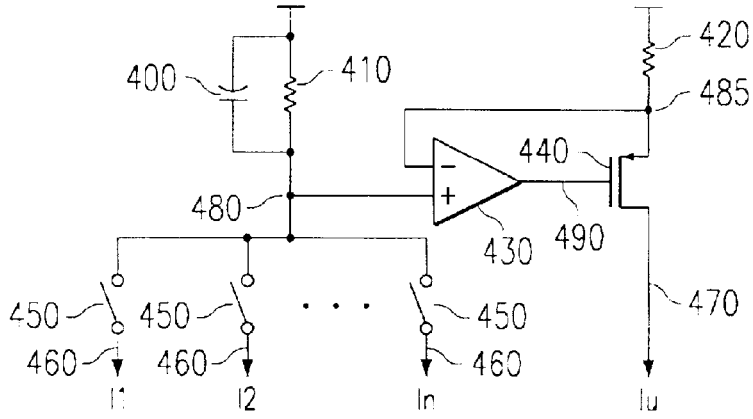
FIGS. 4, 5, and 6 are schematic circuit diagrams of particular implementations of the device of FIG. 3.

FIG. 4 shows a particular implementation of the circuit of FIG. 3 in which the averaging and signal translation is done using a simple RC network composed of resistor 410 and capacitor 400. The multiplexing circuit is composed of the current switch bank 450, which randomly or sequentially selects currents 460 (I1, I2, . . . , In). In this case the signals on lines 340 and 350 of FIG. 3 are the same, and they are exhibited at node 480. The signal at node 480 is a low pass filtered version of the currents I1, I2, . . . In multiplied by the resistor 410 value, say R. It can be seen that the signal translation here is a simple multiplication, i.e., f2 is a linear function. As will be seen when considering the next circuit implementation, linear functions are desirable as they make implementation easier than nonlinear ones. The average replication circuit, which consists of resistor 420, amplifier 430, and transistor 440, produces current Iu (470) to drive the output; typically this is taken to the LSB driver which copies it using some current-copying scheme. (In such a case at least two LSB drivers will be required, with one being used for normal DAC operation, whilst the other is calibrated from 470 using current copying. These LSB drivers can be interchanged at low frequency much below the DAC clock rate, so that any tones introduced from this switching into the DAC output spectrum are at very low frequency). The circuit of FIG. 4 is based upon a feedback loop which makes the current Iu equal to the average current in resistor 410, assuming that the resistors 410 and 420 are matched in value to within the required precision, and the opamp 430 open-loop gain A is also sufficiently high so as to make the gain factor A/(1+A) negligible at this precision.

The resistor matching can be obtained by interdigitation, common-centroid, and other layout techniques which will be familiar to those skilled in the art. Since only two resistor values have to be matched, this can be done to very high accuracy. Size of the resistor is not important, since parasitic capacitance helps the low-pass filtering process by increasing the size of the capacitor 400. This further facilitates layout of the resistors 410 and 420 for good matching. The opamp 430 design is also straightforward since although high gain is required, high speed is not, and a large compensation capacitor can be placed at node 485 to stabilize the feedback loop.

Figure 5:
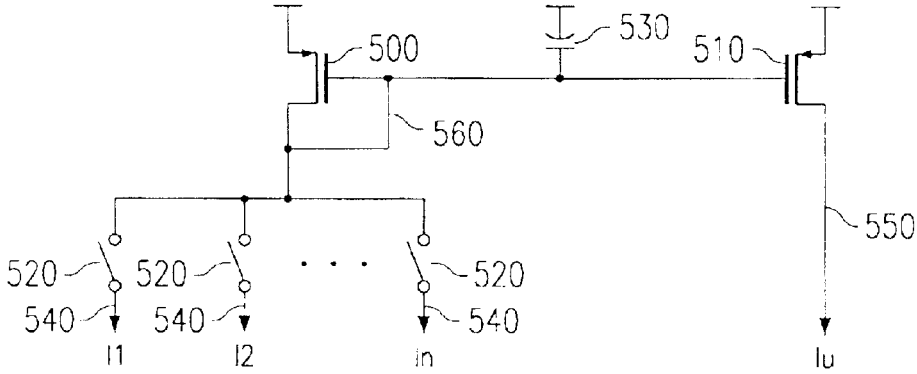

Another particular implementation of the circuit of FIG. 3 which does not require an opamp is shown in FIG. 5. This circuit utilizes a matched current mirror composed of devices 500 and 510. The matching requirements and considerations on these devices are similar to those described for the resistors 410 and 420 of FIG. 4. A capacitor 530 is again used for the low-pass filtering function, with the time constant this time being of form gm/C instead of 1/RC, where gm is the transconductance of device 500.

Once again in this circuit, the signals 340 and 350 of FIG. 3 are the same, being exhibited at node 560, but the function f2 is no longer linear, since the parameter passed to the replica circuit (the mirror transistor 510) is now simply the gate-to-source voltage Vgs of device 500. This voltage follows a square-root relationship with the input current of 500. Using the first-order model of MOSFET devices, we can write:

$$Vgs = \frac{Vgs1 + Vgs2 + \ldots + Vgsn}{n}$$

where Vgsi(I=1) is the gate-to-source voltage that would result from connecting current Ii to device 500. It can be seen that the average of the low pass filter causes the mean of the Vgsi to appear at node 560. Owing to the square root relationship, if I is the current flowing in the device, we can always write Vgs=k√I for some constant k. We therefore obtain for Vgs:

$$Vgs = \frac{k\left(\sqrt{I1} + \sqrt{I2} + \ldots + \sqrt{In}\right)}{n}$$

resulting in an output current Iu of (assuming matched devices 500 and 510):

$$Iu = \frac{\left(\sqrt{I1} + \sqrt{I2} + \ldots + \sqrt{In}\right)^2}{n} \neq \frac{I1 + I2 + \ldots + In}{n}$$

so that we see that in general current Iu is not the true arithmetic mean desired. However, for current Ii sufficiently close to Iu (i=1 to n), we do get that Iu is approximately the true arithmetic mean, as can be seen by expanding the expression above in Taylor Series and discarding higher order terms. This is equivalent to saying that if all the Ii are approximately matched, then although the square root characteristic is still present, it is interpolated over only a very small region, so that it can be locally approximated as a straight line. The requirement that the Ii should be approximately matched, sets a design requirement on how close the matching of the Ii must be from the process or other steps taken to statically match the Ii before DEM. The requirement is that the mean value Iu must be close enough to the true mean within the DAC resolution required, since if it is applied to the LSBs, they will be set to Iu, not to the true mean. Thus, for example, obtaining a DAC with 14-bit final accuracy may require 10-bit initial accuracy from the Ii sources. This concern arises only with averaging circuits exhibiting nonlinear transfer functions; it was thus not an issue with the circuit of FIG. 4 which was linear.

Figure 6:
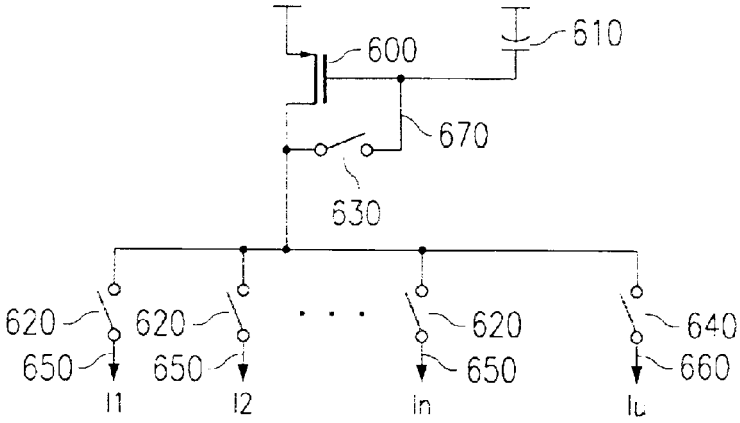

A similar circuit to that of FIG. 5 is shown in FIG. 6. Here the device 510 of FIG. 5 has been dropped and switches 630 and 640 introduced in its place. Capacitor 610 serves the same purpose as capacitor 530 of FIG. 5. The circuit of FIG. 6 has the advantage that no transistor matching is required. It operates on a current-copying principle whereby in one phase (a phase could be several hundred clock cycles), the currents 650 (Ii, i=1 to n) are applied to device 600 in the usual way via the multiplexing switch bank 620. In this phase, switch 630 is closed and switch 640 is open. The gate-to-source voltage of device 600 is therefore developed at node 670. In the other clock phase, the switch 630 is opened to preserve the gate-to-source voltage, and 640 is closed to drive current 660 (Iu) to the point in the circuit where it is used. During this clock phase the switches in the multiplexing switch bank 620 are all opened.

The circuit of FIG. 6 realizes the same function as the circuit in FIG. 5 and does so in a similar fashion except that the average measurement and average replication functions are multiplexed in time instead of being carried out simultaneously. The advantage is that no transistor matching is required as in the circuit of FIG. 5, although the same non-linearity considerations still apply since the mean is taken over Vgsi, not Ii (i=1 to n).

The embodiments described above are very useful in a segmented DAC environment because they allow DEM to be applied to the MSBs without requiring it for the LSBs. This invention extends the averaging function to a time-multiplexed environment where the inputs are interchanged randomly or sequentially to realize a DEM waveform. Therefore, a low-pass filtering component has to be added. Once the average is obtained, it is transferred in some form to an average replication circuit which replicates it at some other point in the circuit. This average replication function is introduced because it is required in the segmented DAC applications mentioned.

Various embodiments of circuits which carry out the average-measurement and average-replication functions have been described. These embodiments carry the following advantages. All embodiments can carry out the basic average measurement and replication functions in a high-speed and high-resolution environment. The DEM inputs can be switched at the high speed clock rate for good averaging, but the rest of the circuit is low speed and easy to design. One implementation of the preferred embodiment (FIG. 4) carries the advantage of a linear transfer function in transferring the average information to the replication circuit. This ensures correct operation even if the input signals are widely spaced. This preferred embodiment requires an opamp which is simple to design because of the low-speed requirement. Another implementation (FIG. 5) is simple in terms of transistor count and can be made high accuracy by the layout of the two transistors involved, and by matching the DEM current sources to sufficiently high initial precision. Another implementation (FIG. 6) is simplest in terms of transistor count and can be made high accuracy by matching the DEM current sources to sufficiently high initial precision only.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An averaging circuit comprising:

input signal nodes for providing input signals;

a multiplexing circuit coupled to the input signal nodes for switching between the input signals to create a time waveform;

a low pass filter coupled to an output of the multiplexing circuit for filtering the time waveform to create an average signal; and an average replication circuit coupled to an output of the low pass filter.

2. The circuit of claim 1 wherein the multiplexing circuit comprises a switch bank coupled to the input signal nodes.

3. The circuit of claim 2 wherein the low pass filter comprises an RC circuit.

4. The circuit of claim 3 wherein the RC circuit comprises a resistor coupled in parallel with a capacitor.

5. The circuit of claim 1 wherein the low pass filter comprises an RC circuit.

6. The circuit of claim 5 wherein the RC circuit comprises a resistor coupled in parallel with a capacitor.

7. The circuit of claim 6 wherein the average replication circuit comprises:

an amplifier having a first input coupled to the resistor;

a transistor having a control node coupled to an output of the amplifier and a non-control node coupled to a second input of the amplifier; and a replication resistor coupled to the second input of the amplifier.

8. The circuit of claim 7 wherein the resistor and the replication resistor are matched.

9. The circuit of claim 1 wherein the average replication circuit comprises:

an amplifier having a first input coupled to the output of the low pass filter;

a transistor having a control node coupled to an output of the amplifier and a non-control node coupled to a second input of the amplifier; and a resistor coupled to the second input of the amplifier.

10. The circuit of claim 1 wherein the multiplexing circuit randomly selects the input signal nodes.

11. The circuit of claim 1 wherein the multiplexing circuit sequentially selects the input signal nodes.

12. The circuit of claim 1 wherein the low pass filter comprises:

a transistor coupled to the output of the multiplexing circuit; and a capacitor coupled to a control node of the transistor and to the output of the multiplexing circuit.

13. The circuit of claim 12 wherein the average replication circuit comprises a replication transistor having a control node coupled to the capacitor.

14. The circuit of claim 13 wherein the transistor and the replication circuit are matched.

15. The circuit of claim 12 wherein the average replication circuit comprises:

a first switch coupled between the multiplexing circuit and the control node of the transistor; and a second switch coupled between the multiplexing circuit and an output node.

16. The circuit of claim 1 wherein the average replication circuit comprises a transistor having a control node coupled to the low pass filter.

* * * * *